United States Patent [19]

Chachin et al.

[11] Patent Number: 4,519,230

[45] Date of Patent: May 28, 1985

[54] APPARATUS FOR SIZING OF TUBES

[75] Inventors: Viktor N. Chachin; Vladimir K. Kolos; Viktor V. Botyan, all of Minsk; Viktor M. Postnikov, Ivanovo, all of U.S.S.R.

[73] Assignee: Fiziko-Tekhnichesky Institut Akademii Nauk Belorusskoi SSR, Minsk, U.S.S.R.

[21] Appl. No.: 552,175

[22] PCT Filed: Feb. 2, 1982

[86] PCT No.: PCT/SU82/00001

§ 371 Date: Sep. 30, 1983

§ 102(e) Date: Sep. 30, 1983

[87] PCT Pub. No.: WO83/02576

PCT Pub. Date: Aug. 4, 1983

[51] Int. Cl.[3] ..... B21D 26/02

[52] U.S. Cl. ..... 72/56; 29/421 E; 72/62

[58] Field of Search ..... 29/421 R, 421 E; 72/56, 72/61, 62, 63

[56] References Cited

U.S. PATENT DOCUMENTS

| | | | |
|---|---|---|---|
| 3,487,668 | 1/1970 | Fuchs | 72/61 |
| 4,049,367 | 9/1979 | Tominaga | 72/56 |
| 4,210,991 | 7/1980 | Cooper | 72/56 |

FOREIGN PATENT DOCUMENTS

| | | |
|---|---|---|
| 1777344 | 8/1976 | Fed. Rep. of Germany . |
| 2046012 | 3/1971 | France . |
| 1218613 | 1/1979 | United Kingdom . |
| 606538 | 5/1974 | U.S.S.R. . |
| 377181 | 12/1974 | U.S.S.R. . |

*Primary Examiner*—Leon Gilden

*Attorney, Agent, or Firm*—Fleit, Jacobson, Cohn & Price

[57] ABSTRACT

An apparatus for sizing of tubes under the pressure of fluid comprises a split die (2) with a lock mounted on a bed (1) and provided with a horizontally arranged sizing channel (3) corresponding to the shape of a tube (7), a mandrel (6) for setting the tube (7) in the sizing channel (3) coaxially therewith, a means for delivery of fluid into a clearance (10) between the mandrel (6) and the tube (7), packings (19) for sealing the clearance (10) between the mandrel (6) and the tube (7), a hydraulic striker unit (24) for building up the pressure of fluid in the clearance (10), incorporating a working chamber (34) filled with a fluid and a vertically arranged receiver (30) with a barrel (25) wherein slides a striking ram (26) which at the impact builds up the pressure of fluid in the working chamber (34) connected to the sizing channel (3) of the die (2) through the medium of an adapter (36) joined to the sizing channel (3) and provided with a piston (37) serving for isolating the fluid filling the working chamber (34) of the hydraulic striker unit (24) from the fluid delivered into the clearance between the mandrel (6) and the tube (7).

2 Claims, 4 Drawing Figures

APPARATUS FOR SIZING OF TUBES

TECHNICAL FIELD

The present invention relates to plastic metal working under the fluid pressure and is specifically concerned with apparatuses for sizing of tubes.

BACKGROUND ART

A problem existing in the mechanical engineering is associated with production of high-precision long-size tubes from difficult-to-form metals and alloys used in particular in manufacture of jackets for runover rolls of textile finishing machines and impression rollers of rotary printing machines. Very stringent requirements are imposed upon the accuracy of manufacture of such tubes, as an increase in the rotational speed of the rolls or rollers intended to step up the output of the machines may cause intensive oscillations and rupture of the moving material (textile fabric, paper tape). For example, in the jackets for runover rolls of textile finishing machines with the length of the roll amounting to 2200 mm, the runout must not exceed 0.4 mm.

Known in the prior art are apparatuses or production of such tubes, wherein a tube is sized in a die under the pressure of flulid.

There is known an apparatus for sizing of tubes intended for production of rollers for printing machines (cf. USSR Inventor's Certificate No.606,538 published in the journal "Discoveries, Inventions, Industrial Designs and Trademarks", 1978, No.17), comprising a die with a sizing channel in which a tube is installed. Inserated in the tube interior with the purpose of reducing the unbalance of these rollers is at least one additional tube which is shorter in length and whose outside diameter is equal to the inside diameter of the tube being sized. An elastic bag is introduced in the space of the tubes and the ends of the tube blank are hermetically sealed with stoppers. Deformation of the tubes is accomplished by pressure of the forwking medium delivered from a static pressure source into the elastic bag along a pipeline passing through one of the die end stoppers.

Due to a static character of the tube blank loading, such an apparatus cannot ensure a high level of accuracy in sizing of tubes.

Besides the apparatus is inconvenient in servicing.

The preparatory operations associated with installation of additional tubes in the main tube and also with introduction of the elastic bag in the interior of these tubes are substantially labour-and time-consuming.

Also known in the prior art is an apparatus for sizing of tubes under the pressure of fluid (cf. USSR Inventor's Certificate No.377,181 published in the journal "Discoveries, Inventions, Industrial Designs and Trademarks", 1973, No.18) in which a tube is sized portionwise. The apparatus comprises a split die mounted on a bed and provided with a horizontally arranged sizing channel corresponding to the shape of a tube, which accommodates a mandrel for setting the tube coaxially with the sizing channel, a means for delivery of fluid in the hermetically sealed clearance between the mandrel and the tube, and a means for building up the pressure of fluid in the clearance between the mandrel and the tube. The mandrel is provided with passages for delivery of the fluid into the clearance between the mandrel and the tube. At the ends the mandrel has circular grooves which are connected with the passages for delivery of the fluid and accommodate elastic packings which hermetically seal the clearance between the mandrel and the tube. The die is installed for a reciprocating movement along the guideways provided on the bed and arranged parallel to the mandrel. The halves of the die are opened and closed with the aid of hydraulic cylinders which also take up the pressure transmitted to the die in the process of sizing. The tube is moved for a successive sizing by means of a carriage provided with a centering device for one end of the tube being sized.

By means of the carriage the tube is pushed in the die set in one extreme position, then the die is closed and the tube complete with the carriage and the die is moved further along the guideways to the other extreme position of the die, thereby slipping the tube portion encompassed by the die over the mandrel for sizing. Then the fluid is delivered into the clearance between the mandrel and the tube, and the latter is plastically deformed when the predetermined pressure of fluid is reached. Thereafter, the die is opened, moved through one step backward in the direction of a non-sized portion of the tube, closed again and slipped complete with the tube over the mandrel for sizing the next portion of the tube. The return movement of the die is necessary to preliminarily aliminate ovality of the tube portion before its sizing.

In the process of static sizing under the pressure of fluid the tube expands and from the beginning of deformation till the moment the tube comes in contact with the die wall, the tube blank is subjected to a free expansion characterized by an unfavorable pattern of the state of stress, with the result that the plastic flow of metal is not uniform due to the presence of weakened areas (defects, thinned wall) in the tube material. This condition reduces the quality of tubes received after sizing.

When tubes are manufactured from strain hardening materials (for example, stainless steels) the succesive portionwise sizing leads to a premature hardening of the material at the boundary of the sized and non-sized portions of the tube. This increases the nonuniformity of stresses set up at a successive tube portion in the process of its sizing, and thereby changes the spring back of the material at the boundaries of the tube portions. This condition also impairs the quality of tubes as the production of precision tubes with the sizing performed under the static pressure of fluid is possible only when the value of the material spring back after removal of the load is taken into consideration.

The successive portionwise sizing cannot provide for an accurate contour of the tube shell along the generator (i.e. it cannot correct the tube curvature) as the sizing portion of the apparatus, the split die, is moved along the guideways relative to the fixed mandrel. As a result, an error caused by nonparallelism in movement of the die and by different settings of the die on the guideways will be introduced in the total error.

The apparatus described herein before has a low output resulting from the multiple loading required in the portionwise sizing. The total time required for sizing a tube throughout its full length is practically as many times greater than a single cycle of sizing a separate portion of the tube as many times the tube length is greater than the length of the die sizing portion, since the sizing of each new portion of the tube necessitates repetition of all the steps needed for accomplishment of the given operation.

In addition, the ends of tubes remain non-sized due to the fact that the clearance between the mandrel and the tube is sealed on the tube inside diameter with the aid of packings installed in the circular grooves provided on the external surface of the mandrel. These non-sized ends of tubes should be cut off (which increases consumption of the material) or any other method should be used for correcting the remaining defects.

DISCLOSURE OF THE INVENTION

The invention is essentially aimed at providing an apparatus for sizing of tubes equipped with such a means for building up the pressure of fluid in the clearance between the mandrel and the tube which will improve the quality of tube sizing.

This aim is attained by that in an apparatus for sizing of tubes under the pressure of fluid, comprising a split die mounted on a bed and provided with a horizontally arranged sizing channel corresponding to the shape of a tube and accommodating a mandrel for setting the tube coaxially with the sizing channel, a means for delivery of fluid in the hermetically seald clearance between the mandrel and the tube, and a means for building up the pressure of fluid in the clearance between the mandrel and the tube, according to the invention the means for building up the pressure of fluid in the clearance between the mandrel and the tube is made in the form of a hydraulic striker unit comprising a working chamber filled with a fluid, a vertically arranged receiver with a barrel wherein slides a striking ram which builds up the pressure of fluid in the working chamber at the impact, and an adapter through which the working chamber is connected to a sizing channel and which accommodates a piston intended for isolating the fluid filling the working chamber of the hydraulic striker unit from the fluid delivered into the clearance between the mandrel and the tube.

To improve the quality of sizing the ends of a tube, it is desirable to connect the adapter with the die sizing channel through the medium of a hydrodynamic clamp compirising a cylinder installed in the die coaxially with the sizing channel and provided with an annular bottom which rests against the face of the adapter of the hydraulic striker unit, a hollow two-step piston installed in the cylinder, the diameter of the smaller step thereof being equal to the diameter of the die sizing channel, and rested by its face against the tube end, a connecting bush with a flange internally installed in the adapter so that the flange of the connecting bush is arranged inside the cylinder and by one face contacts the internal surface of the cylinder bottom, while the other face together with the face of the piston forms an annular clearance which widens towards the axis of the cylinder, and a throttling bush arranged inside the piston and the connecting bush, and provided with radial holes located opposite to the annular clearance.

The use of the hydraulic striker unit which is essentially a high-energy source provides for technological possibilities of sizing a tube throughout its full length in one operation. The clearance between the tube blank and the inside diameter of the die allows the full volume of the material to be involved right before the sizing against the die surface, into a high-speed plastic deformation which takes place under conditions of high pressures exerted on the tube by shock waves which sets up a favorable state of stress in the zone of deformation. This not only improves the conditions of creep in the metal and increases plasticity of the majority of metals (including stainless steels, titanium alloys and other difficult-to-form materials), but also equalizes the stresses across the section of the tube blank. Thus, an adverse effect of the material defects and local thinned spots is reduced and the conditions for the metal spring back are practically eliminated. Meeting at a high speed with the die wall, the material of the tube blank is subjected to extremely high braking accelerations which set up inertia increments of substantial value to the stresses developed in the metal under the action of external pressure forces. At the final stage of the process this fact provides the conditions for plastic flow of the metal both in the macro and microvolumes. After such a sizing the external surface of the tube is essentially an exact copy of the die internal contour.

BRIEF DESCRIPTION OF THE DRAWINGS

The invention will now be described in greater detail with reference to a specific embodiment thereof, taken in conjunction with the accompanying drawings, wherein.

BEST MODE FOR CARRYING OUT THE INVENTION

Figure 1:
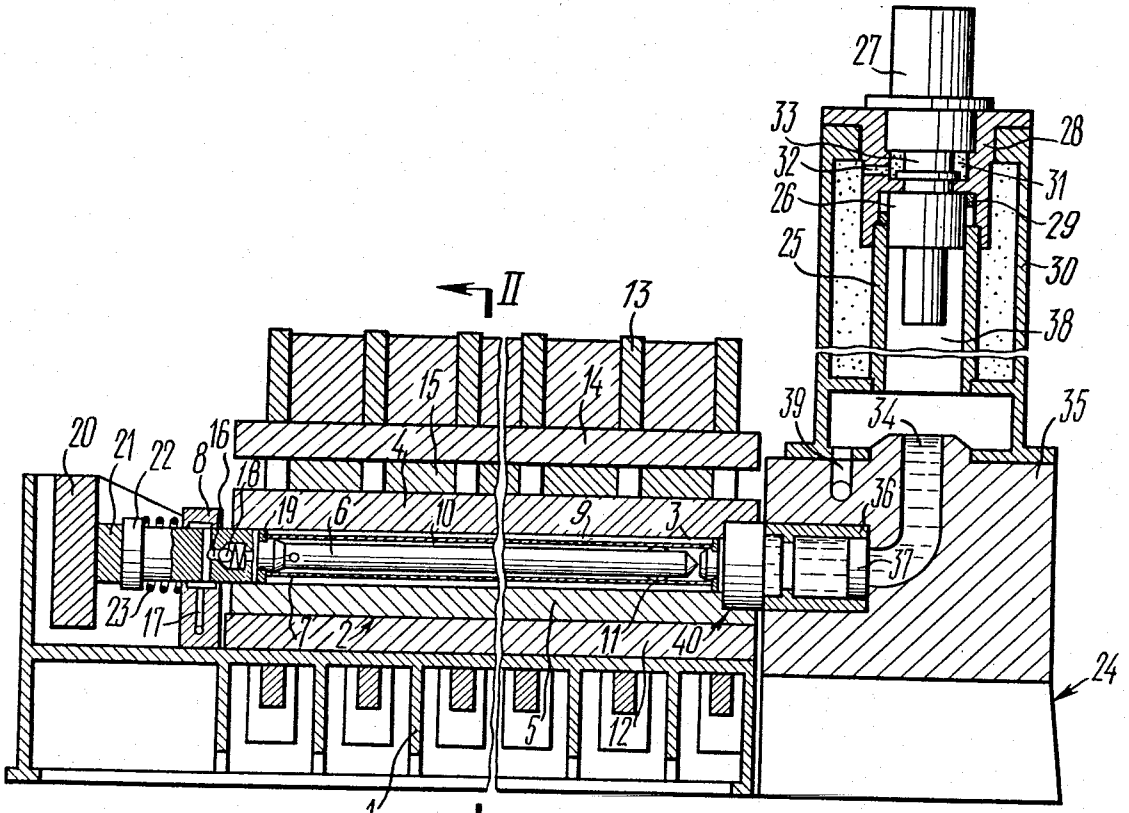
FIG. 1 is a general view of an apparatus for sizing of tubes in a position before sizing (longitudinal section), according to the invention.

An apparatus for sizing of tubes under the pressure of fluid comprises a split die 2 (FIG. 1) having a lock and mounted on a bed 1. The die 2 has a horizontal sizing channel 3 corresponding to the shape of a tube and formed by an upper half-die 4 and a lower half-die 5.

The apparatus also comprises a mandrel 6 for setting a tube 7 coaxially with the sizing channel 3. One end of the mandrel 6 is supported as a cantilever by lever 8. The tube 7 is installed in the die 2 on the mandrel 6 so that there is a clearance 9 between the external surface of the tube 7 and the surface of the sizing channel 3, and a clearance 10 between the internal surface of the tube 7 and the surface of the mandrel 6. For centering the tube 7 relative to the mandrel 6 and the die 2, a collet 11 is secured on the free end of the mandrel 6.

The lower half-die 5 is fixedly secured on the bed 1 through a pad 12, while the half-die 4 is connected with the movable parts of a lock intended for closing the joint between the half-dies 4 and 5. The lock comprises clips 13 fastened by means of a plate 14 and wedges 15 kinematically associated with actuating hydraulic cylinders (not shown in the Figure) arranged between the upper half-die 4 and the plate 14 in the spacings between the clips 13.

For delivery of fluid in the clearance 10 between the mandrel 6 and the tube 7, the mandrel 6 and the lever 8 are provided with passages 16, 17 fitted with a check valve 18, and communicated with a reservoir (not shown in FIG. 1) for fluid.

For sealing the clearance 10 between the tube 7 and the mandrel 6, the sizing channel 3 is fitted with packings 19 installed at the ends of the tube 7.

For pressing the tube 7 against the packings 19, a wedge 21 is installed on a bracket 20 secured on the bed 1.

For returning the mandrel 6 to the initial position, a spring 23 is installed between the lever 8 and a collar 22 of the mandrel 6.

For building up the pressure of fluid in the clearance 10 between the mandrel 6 and the tube 7, the apparatus for sizing of tubes comprises a hydraulic striker unit 24 incorporating a cylindrical barrel 25 which accommodates a striking ram 26 provided with a starting mechanism 27 and a means (not shown in the Figure) for returning the striking ram 26 to the extreme upper (initial) position. Usually, this means is made in the form of hydraulic pumps. For holding the striking ram 26 in the extreme upper position, a collet 29 is installed in a cover 28. The barrel 25 is encompassed by a receiver 30 filled with a compressed gas. To by-pass the compressed gas from the receiver 30 into a space 31 disposed above the striking ram 26, the cover 28 is provided with a passage 32 and a valve 33 of the striking mechanism 27.

The hydraulic striker unit 24 also incorporates a working chamber 34 made in the form of a curved passage in a solid metal body 35. The space of the working chamber 34 is filled with the fluid presenting a working medium which when struck by the striking ram 26 builds up the fluid pressure required for sizing the tube 7. The working chamber 34 is connected to the sizing channel 3 of the die 2 through the medium of an adapter 36. For isolating the fluid filling the working chamber 34 of the hydraulic striker unit 24 from the fluid delivered into the clearance 10 between the mandrel 6 and the tube 7, the adapter 36 is provided with a piston 37, since a cutting emulsion is used as a fluid delivered into the clearance 10 and oil is used as a fluid for filling the working chamber 34.

To transmit pressure from the hydraulic pump (not shown in the Figure) into a space 38 arranged under the striking ram 26 for returning the striking ram 26 to the initial position, a passage 39 is made in the body 35 of the working chamber 34.

For sealing the clearance between the mandrel 6 and the tube 7 in the process of its deformation and for a simultaneous sealing of the joint between the hydraulic striker unit 24 and the die 2, the use is made of a hydrodynamic clamp 40.

Bed 1 is provided on both sides of the die 2 with ears 41 (FIGS. 2, 3) and 42 secured in pairs by means of rods 43. The clips 13 are connected with the ears 41 by means of axles 44 adapted for turning through an angle of approximately 90° and are kinematically associated with the hydraulic cylinders (not shown in the Figure) for installing the half-die 4 on the half-die 5. The clips 13 are connected with the ears 42 by pins 45 installed through the medium of brackets 46 on a movable rod 47 actuated with the aid of a hydraulic cylinder (not shown in FIG. 2).

Figure 2:
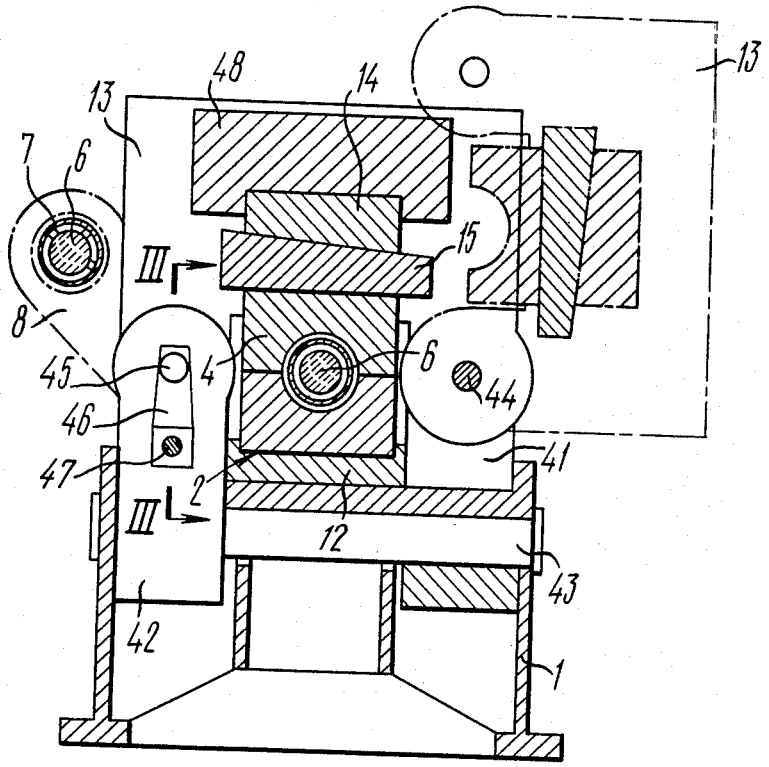
FIG. 2 is a cross section of an apparatus for sizing of tubes taken on the line II—II of FIG. 1, according to the invention.
Figure 3:
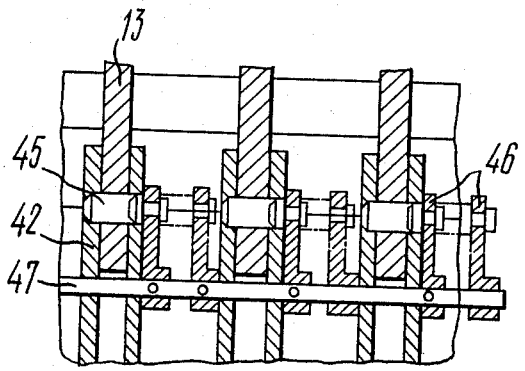
FIG. 3 is a section taken on the line III—III of FIG. 2.

The clip 13 turned through 90° is shown in FIG. 2 with a dash-dot line.

The lever 8 (in FIG. 2 it is shown in a turned position with a dash-dot line) is adapted for turning through an angle of approximately 135° about the axis coinciding with the axis of the pins 45, in order to bring the mandrel 6 with the tube 7 into the die 2.

A coupled mass in the form of metal blocks 48 may be arranged between the clips 13 on the plate 14 for damping excessive inertia loads transmitted to the half-die 4 from the tube 7.

Figure 4:
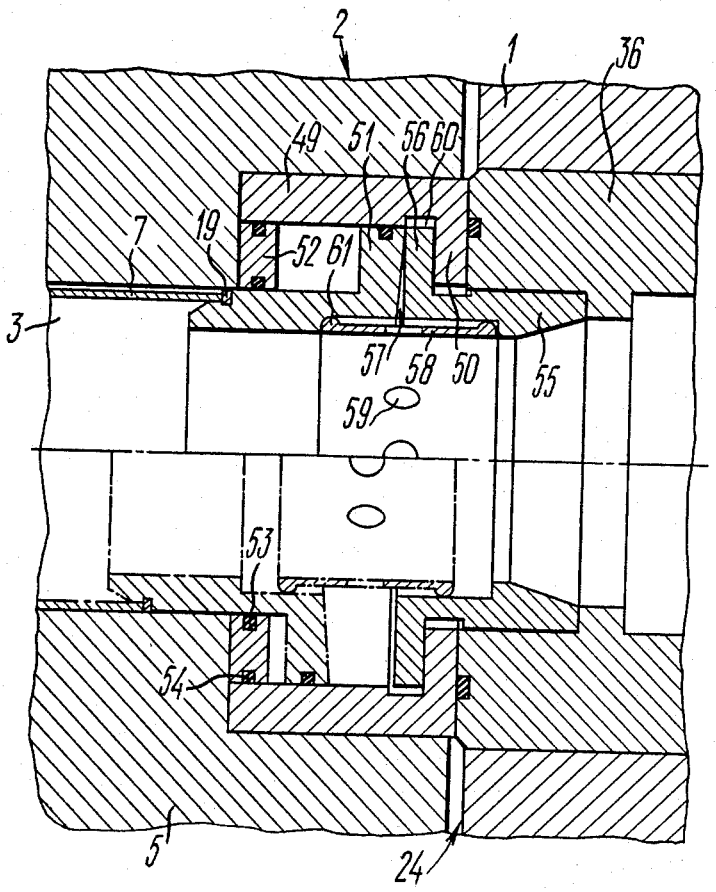
FIG. 4 is a longitudinal section of a hydrodynamic clamp drawn to an enlarged scale, according to the invention.

The hydrodynamic clamp 40 comprises a cylinder 49 (FIG. 4) with a circular bottom 50 installed in the die 2 coaxially with the sizing channel 3. The inside diameter of this cylinder 49 is greater than the diameter of the sizing channel 3. The bottom 50 rests against the adapter 36 of the hydraulic striker unit 24. The cylinder 49 internally accommodates a hollow two-step piston 51 whose step of a smaller diameter enters the sizing channel 3 and rests through the packing ring 19 against the end of the tube 7. The space of the cylinder 49 is sealed by means of a ring 52 provided with rubber packings 53 and 54. The hydrodynamic clamp 40 also incorporates a connecting bush 55 with a flange 56 internally installed in the adapter 36 so that the flange 56 of the connecting bush is arranged inside the cylinder 49 and by one face contacts the internal surface of the bottom 50 of the cylinder 49, while the outer face of the flange 56 together with the face of the piston 51 forms an annular clearance 57 which widens towards the axis of the cylinder 49.

A throttling bush 58 with radial holes 59 arranged opposite to the annular clearance 57 is installed inside the piston 51 and the connecting bush 55.

To compensate for axial misalignment of the adapter 36 of the hydraulic striker unit 24 and the sizing channel 3, and to prevent the hydraulic clamp 40 from breaking at the moment the striking ram 26 strikes the fluid filling the working chamber 34 during which the hydraulic striker unit 24 displaces relative to the die 2, a groove 60 is provided between the cylinder 49 and the flange 56, and the throttling bush 58 has supporting shoulders 61 with a toroidal surface.

The apparatus for sizing of tubes operates in the following manner.

In the initial position the upper half-die 4 (FIGS. 1, 2) with the plate 14, the wedges 15, the clips 13 is turned about the axis 44 clockwise through an angle of 90° and the mandrel 6 is withdrawn in the servicing zone by turning the lever 8 counter-clockwise.

In this position the tube 7 is mounted on the mandrel 6, then the mandrel 6 with the tube 7 is turned clockwise and set concentrically in the lower half-die 5, then the latter is covered with the upper half-die 4 which moves together with the clips 13, the plate 14 and the wedges 15. The movable pins 45 (FIG. 3) secured on the brackets 46 are brought in the holes of the clips 13 by actuating the rod 47, then the half-dies 4 and 5 are compressed by wedges 15 (FIGS. 1, 2) and the mandrel 6 is pressed by the wedge 21 to seal the ends of the tube 7. Thereafter, through the system of the passages 16, 17 and the check valve 18, the fluid (for example, an emulsion) is delivered into the clearance 10 between the mandrel 6 and the tube 7; the same fluid is also delivered into the space of the adapter 36 of the hydraulic striker unit 24 for moving the piston 37 in the extreme right-hand position.

To perform the sizing operation, the valve 33 is lifted by means of the starting mechanism 27; as a result, the air contained in the receiver 30 is admitted into the space 31 above the striking ram 26 and accelerates the latter to a high speed (50–100 m/s). The striking ram 26 strikes the fluid contained in the working chamber 34 and builds up therein a high impulse pressure which is transmitted through the medium of the piston 37 to the fluid filling the clearance 10 between the mandrel 6 and the tube 7.

Acting on the tube 7 from the inside, the pressure impulse developed in the fluid performs the plastic deformation of the material of the tube 7 and the sizing of its external surface against the die 2. Through the holes 59 and the annular clearance 57 the pressure of fluid acts on the face of the hollow two-step piston 51 moving the latter right after the end of the tube 7 which gets shortened in length in the process of its sizing by expansion. Due to this fact the packings remain constantly pressed against the ends of the tube 7, thereby providing the sealing of the joint between the mandrel 6 and the tube 7.

After the sizing is completed the wedges 21 and 15 are withdrawn with the aid of the hydraulic cylinders. As a result, the half-dies 4 and 5, and the mandrel 6 are released and the latter is returned to the initial position under the action of the spring 23. At the same time compressed air is delivered into the space of the cylinders 49 between the ring 52 and the piston 51 to move the piston 51 to the right in the initial position (until it rests against the flange 56); as a result, the piston 51 is brought out of contact with the tube 7 and does not prevent the tube from being withdrawn by the mandrel 6 in the servicing zone. Then the pins 45 are removed from the clips 13, the upper half-die 4 is turned clockwise, the mandrel 6 together with the sized tube 7 is withdrawn in the servicing zone and removed; thereafter, a next tube 7 is installed in place of the removed one.

Concurrently with the opening of the die 2 and withdrawal of the mandrel 6 with the tube 7, the striking ram 26 is returned to the initial (upper) position. To this end, the hydraulic pump is switched on to deliver the fluid in the passage 39; the fluid lifts the striking ram 26, thereby forcing the compressed gas that has expanded in the space of the barrel 25, into the receiver 30. As soon as the striking ram 26 reaches the upper position, the starting mechanism 27 is used to lower the valve 33 which closes the inlet section of the barrel 25, thereby disconnecting the barrel 25 from the receiver 30. In the upper position the striking ram 26 is held by the collet 29. Thereafter, the fluid is drained from the space of the barrel 25 in the tank through the passage 39. The apparatus is ready to perform the next working cycle.

The use of the apparatus for sizing of tubes of the design described heretofore makes it possible to size the tubes with a high accuracy. An experimental test carried out on a laboratory installation has proved that the accuracy of sized articles is practically determined by the accuracy of the die manufacture. For example, in sizing of a stainless steel tube dia $102\times2$ mm and 1000 mm long the curvature of the generator comprised 0.01 mm, with the accuracy of diameter dimensions being determined by the surface roughness. The generator of the die internal surface had the same curvature.

Sizing a tube throughout its full length in one step with the provision of a mechanized delivery of the tube blank in the die and a mechanized withdrawal of the ready article in the operator servicing zone allowed the time of the tube sizing to be substantially cut down. The time for performing the operation from the installation of a tube on the mandrel and till the removal of the sized article is equal to 60 s.

INDUSTRIAL APPLICABILITY

The apparatus for sizing of tubes is used for production of long-size tubes mainly from difficult-to-form metals and alloys, such as stainless steels and titanium alloys used for manufacture, for example, of jackets for run-over rolls of textile finishing machines and impression rollers of rotary printing machines, with the substantially stringent requirements being imposed on the accuracy of their manufacture.

We claim:

1. An apparatus for the sizing of tubes under the pressure of a fluid, said apparatus comprising:

a bed;

a split die mounted on the bed and provided with a horizontally arranged sizing channel corresponding to the desired shape of a tube to be sized;

a mandrel within the sizing channel for setting the tube coaxially with the sizing channel;

means for delivery of fluid into an hermetically sealed clearance between mandrel and the tube; and means for building up the pressure of fluid between the mandrel and the tube positioned in the sizing channel including an hydraulic striker unit having a working chamber filled with a fluid, a vertically arranged receiver with a barrel, a striking ram slidable within the barrel for building up the pressure of fluid in the working chamber at impact with the fluid, and an adapter for connecting the working chamber to the sizing channel, said adapter including a piston for isolating the fluid filling the working chamber of the hydraulic striker unit from the fluid delivered into the clearance between the mandrel and the tube.

2. An apparatus for the sizing of tubes under the pressure of a fluid according to claim 1, wherein the adapter is connected to the sizing channel of the die through a hydrodynamic clamp comprising a cylinder installed in the die coaxially with the sizing channel and provided with a circular bottom which rests against a face of the adapter of the hydraulic striker unit, a hollow two-step piston slidably received in the cylinder, the diameter of one step thereof being equal to the diameter of the sizing channel of the die and means to sealingly engage the end of the tube, a connecting bush with a flange internally installed in the adapter so that the flange of the connecting bush is positioned inside the cylinder and has one face in contact with an internal surface of the bottom of the cylinder, while another face of the flange together with the face of the piston defines an annular clearance which widens towards the axis of the cylinder, and a throttling bush positioned inside the piston and the connecting bush, and including radial holees located opposite to the annular clearance.

* * * * *